United States Patent [19]

Santini

[11] Patent Number: 4,665,569

[45] Date of Patent: May 19, 1987

[54] PROTECTIVE HELMET FOR SPORT OR WORK

[76] Inventor: Jean-Jacques G. R. Santini, 55, rue de Saint Avertin Tours, Indre et Loire, France

[21] Appl. No.: 798,633

[22] Filed: Nov. 15, 1985

[30] Foreign Application Priority Data

Nov. 26, 1984 [FR] France ..... 84 17983

[51] Int. Cl.[4] ..... A63B 71/10

[52] U.S. Cl. ..... 2/425; 2/410; 2/411

[58] Field of Search ..... 2/425, 410, 411

[56] References Cited

U.S. PATENT DOCUMENTS

| | | | |
|---|---|---|---|
| 1,698,769 | 1/1929 | Mullins | 2/425 |
| 2,793,366 | 5/1957 | Kleinman | 2/411 |
| 4,291,418 | 9/1981 | Zeisler | 2/410 |

FOREIGN PATENT DOCUMENTS

| | | | |
|---|---|---|---|
| 2916297 | 10/1980 | Fed. Rep. of Germany | 2/411 |
| 3239617 | 4/1984 | Fed. Rep. of Germany | 2/410 |
| 2422348 | 12/1979 | France | 2/410 |
| 2041724 | 9/1980 | United Kingdom | 2/411 |

*Primary Examiner*—Werner H. Schroeder
*Assistant Examiner*—J. L. Olds
*Attorney, Agent, or Firm*—Hughes & Cassidy

[57] ABSTRACT

Protective helmets for work and sport. Each helmet has a base part to which a chin guard and two top parts are connected by sutures to form a flexible assembly which is capable of damping and absorbing shocks which would otherwise be transmitted to a head protected by the helmet. The sutures follow the sutures of the human skull which maximizes the protection afforded by the helmet.

10 Claims, 13 Drawing Figures

FIG. 7a
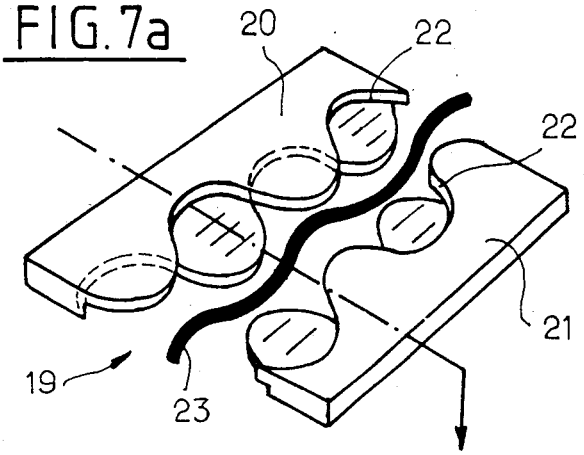
FIG. 8a
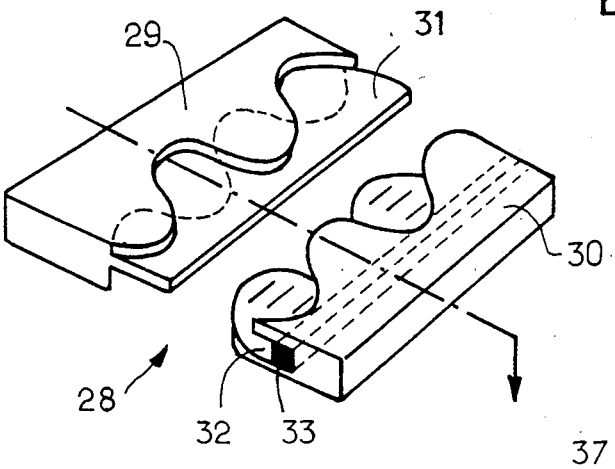
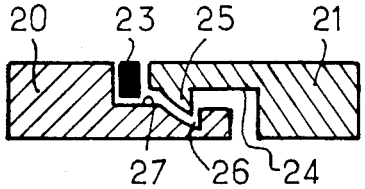
FIG. 7b
FIG. 8b
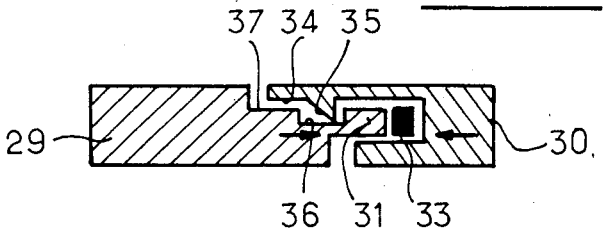

PROTECTIVE HELMET FOR SPORT OR WORK

The invention relates to a protective helmet for sport or work and of the integral cap or other type.

Protective sport or work helmets are already known, integral or otherwise, consisting of an outer shell, an inner cap, padding and a fastening system.

These various elements which constitute the helmet provide relatively satisfactory protection for the bony part of the head, that is to say the skull. However, these conventional helmets are relatively inadequate for protection of the brain. Indeed, in the event of an impact, the vibrations are transmitted to the vital centres by concentric shock waves emanating from the initial impact point. Furthermore, and simultaneously, a shock is followed by a translatory movement of the brain within the brain-pan.

Unfortunately, conventional helmets do not make it possible effectively to influence the concentric shock waves which spread towards the vital centres or the translatory movements of the brain inside the brain-pan.

The object of the present invention is to remedy these drawbacks and proposes to create a protective sport or work helmet, integral or otherwise, which makes it possible effectively to protect not only the bone, that is to say the skull, but which also makes it possible to damp the shocks and limit the propagation of concentric shock waves towards the nerve centres and the translatory movement of the brain inside the brain-pan.

Furthermore, it is an object of the present invention to provide a protective helmet which has a pleasant aesthetic appearance while being very simple to produce and at a favourable prime cost.

To this end, the invention relates to a protective helmet for sport or work and of the integral cap or other type, characterised in that it consists of a plurality of parts interconnected by sutures which essentially reproduce the sutures which connect the bones of the skull.

According to another feature of the invention, the sutures consist of at least one sagittal suture, a horizontal suture and two vertical sutures.

The fact of making the helmet from a plurality of assembled parts and interposing absorbent acoustic seals between the parts which are to be assembled, it is possible to prevent the diffusion of the shock wave. This construction of a helmet from several assembled parts makes it possible not only very effectively to protect the bones of the skull and the brain but also makes it possible to obtain a very rugged and shock-resistant helmet.

According to another characteristic feature of the invention, the sutures are constituted by lines of weakness obtained by perforations which form strips.

According to another characteristic feature of the invention, the sutures define several different and separate parts intended to be assembled in order to form the helmet.

According to another characteristic feature of the invention, the different parts of the helmet, bounded by the sutures, are assembled by interlocking fitment.

According to another characteritic feature of the invention, the different parts which form at least a base part, a chin guard and two top parts, are assembled in a flexible manner, a clearance remaining between the assembled parts of the helmet to permit of relative and limited displacement of the parts inter se following a shock.

According to another characteristic feature of the invention, the helmet constitutes a flexible assembly capable of damping and absorbing shocks, avoiding on the one hand the concentric propagation of a shock wave towards the vital centres of the brain and furthermore the abrupt translatory movement of the brain within the brain-pan.

According to another characteristic feature of the invention, the sutures are of generally rectilinear form.

According to another characteristic feature of the invention, the sutures are generally in the form of a broken line.

According to another characteristic feature of the invention, the sutures are generally in the form of a crenellation.

According to another characteristic feature of the invention, the sutures are in the general form of a sinusoidal line.

According to another characteristic feature of the invention, the junction lines of two adjacent pieces forming the sutures have a corresponding profile, defining an interlocking arrangement in the form of an inverted tooth system, an acoustic seal being clamped between the top faces of the pieces.

According to another characteristic feature of the invention, one of the two pieces to be assembled is provided with an intermediate plate which, in the interlocked position, extends into a housing which is recessed in the other piece, an acoustic seal being clamped in the bottom of the housing by an intermediate plate.

According to another characteristic feature of the invention, the underside of one of two pieces to be assembled is provided with a locking stud engaging into a hollow part provided in the upper face of the other piece.

According to another characteristic feature of the invention, the underside of one of two pieces to be assembled is provided with a locking stud engaging into a recessed part provided in the upper face of the intermediate plate of the other piece.

According to another characteristic feature of the invention, the chin guard is pivotally mounted on the base piece.

Finally, according to another characteristic feature of the invention, the chin guard is mounted on the base piece in such a way as to be displaced by a translatory movement.

The present invention will be more clearly understood with reference to a form of embodiment of protective helmet which is shown diagrammatically and by way on non-limitative example in the accompanying drawings, in which.

Figure 5A:
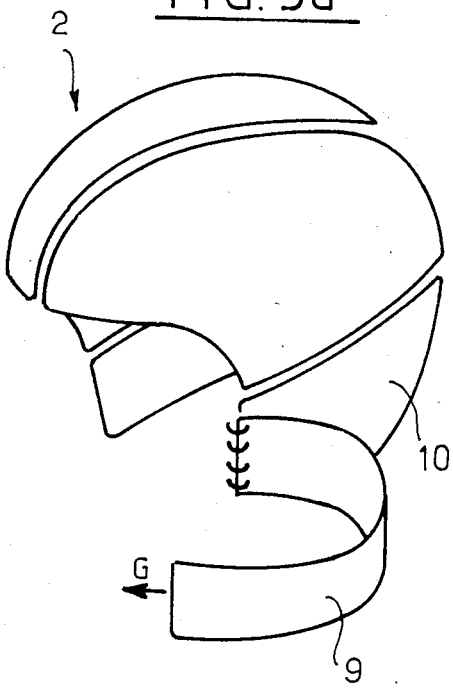
Figure 6:
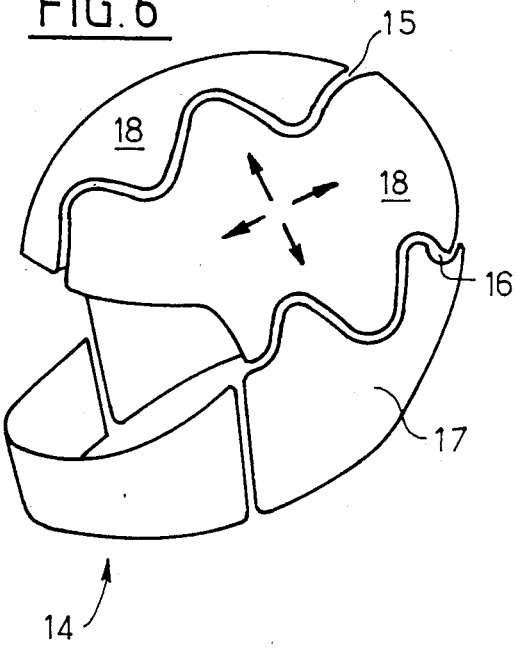
Figure 5B:
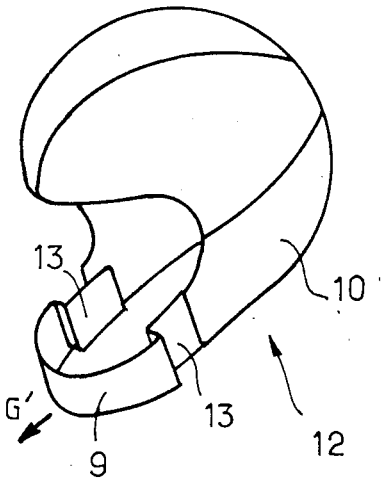

FIG. 5*a* is a perspective view of the helmet with a first embodiment of chin guard;

FIG. 5*b* is a perspective view of the helmet with a second embodiment of chin guard;

FIG. 6 is a perspective view of a third embodiment of the helmet;

FIG. 7*a* is a perspective view of a first type of suture;

FIG. 7*b* is a sectional view corresponding to the suture shown in the preceding FIG. 7*a;*

FIG. 8*a* is a second embodiment of suture;

FIG. 8*b* is a sectional view through the suture according to the preceding FIG. 8*a;*

Figure 9:
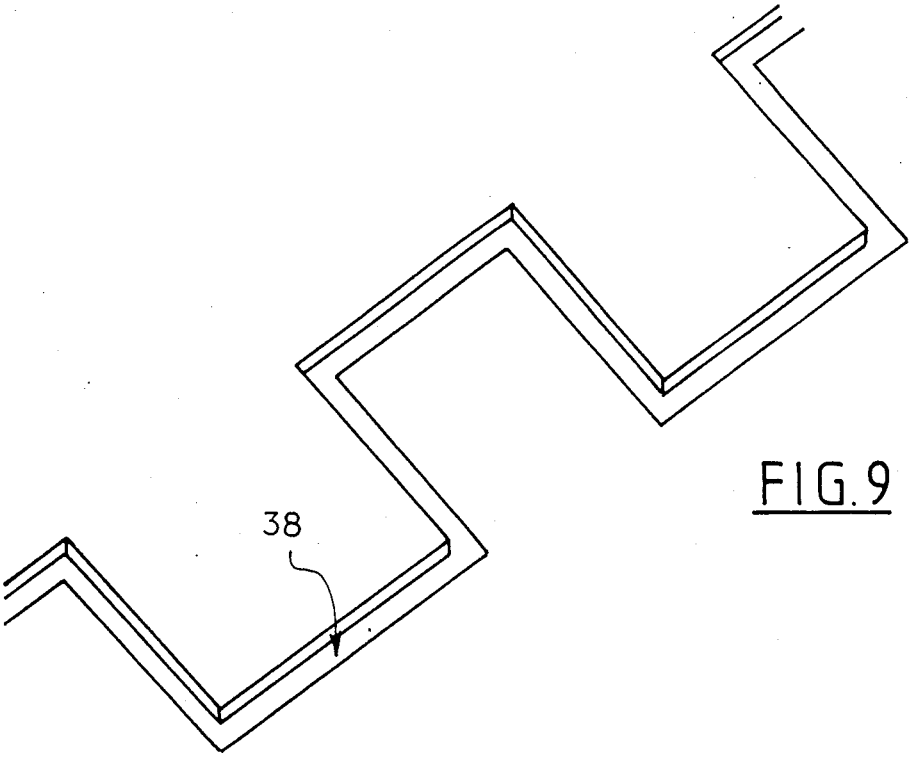
Figure 10:
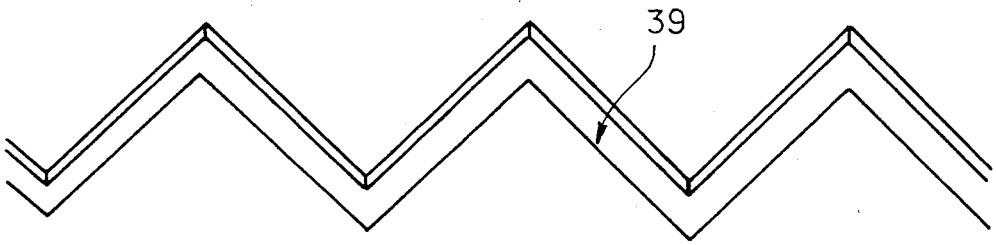

FIG. 9 shows a third embodiment of suture;

FIG. 10 shows a fourth embodiment of suture.

Figure 1:
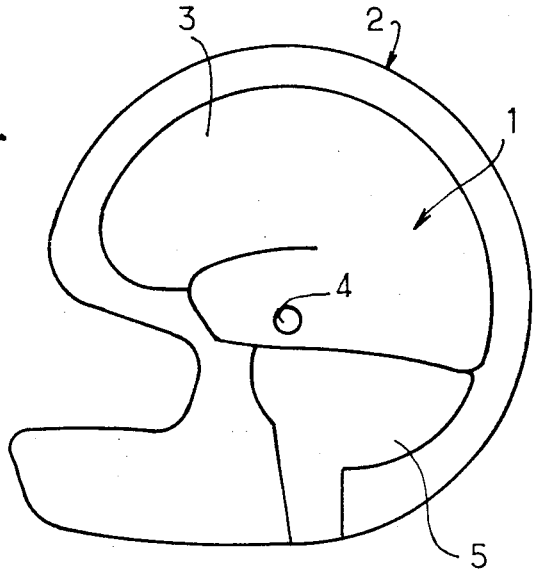
FIG. 1 is a side view of the location of the brain inside the helmet.

According to FIG. 1, the Applicant wishes to show precisely the position of the brain 1 when the user has placed the helmet 2 in position on his head.

Essentially, the brain is constituted by cerebral hemispheres 3, of which only one is visible in the drawing, vital centres 4 and cerebellum 5.

Figure 2:
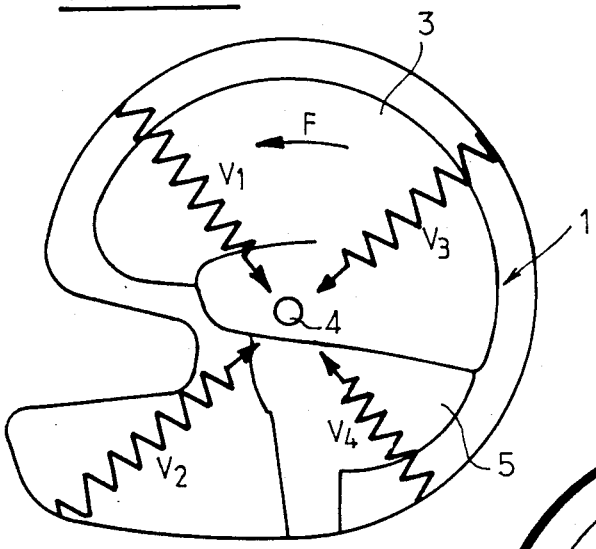
FIG. 2 is a side view according to FIG. 1 and showing the effects of a shock on the brain.

According to FIG. 2, the brain 1 is subjected to various stresses when a shock strikes the helmet. These stresses consist firstly of vibrations V1, V2, V3, V4 which are transmitted to the vital centres 4 via concentric shock waves emanating from the initial impact. Another simultaneous effect resulting from the shock resides in a translatory displacement of the brain 1 in accordance with the arrow F, inside the brain-pan.

Figure 3:
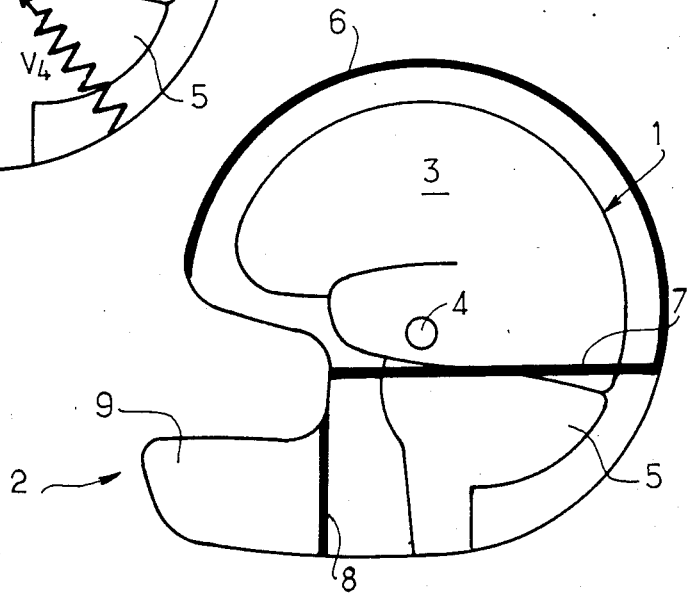
FIG. 3 is a side view of the brain when the helmet is placed on the head of the user.

According to FIG. 3, the protective sport or work helmet 2 is intended to reduce considerably the effects of the vibrations in the direction of the nerve centres and the translatory movement of the brain inside the brain-pan while likewise protecting the bones of the skull. To achieve these results, the helmet 2 comprises a reproduction of the equivalents of the sutures of the skull bones. Thus, the helmet 2 is provided with a sagittal suture 6, a horizontal suture 7 and a vertical suture 8. The sutures 6, 7 and 8 define the various and separate pieces which are assembled. Of course, it is possible to provide for greater parcelling of the helmet by providing a greater number of pieces to be assembled.

The sagittal suture 6 avoids the diffusion of shock waves V1 to V4 from one hemisphere 3 to the other, not shown in the drawings. the horizontal suture 7 avoids the diffusion of these waves from the hemispheres 3 towards the vital centres 4 and the cerebellum 5. This horizontal suture of course prevents diffusion of the waves in the direction opposite to that indicated above.

The vertical suture 8 is likewise very important. It avoids the diffusion of shock waves between the face of the individual and the base of the skull. The vertical suture 8 furthermore defines a chin guard 9 which is attached to the rest of the helmet in such a way that it can be moved into an open position avoiding the need to provide a jugular fastening system such as is conventionally employed.

The sutures 6, 7 and 8 do not in any way affect the ruggedness of the helmet.

Figure 4:
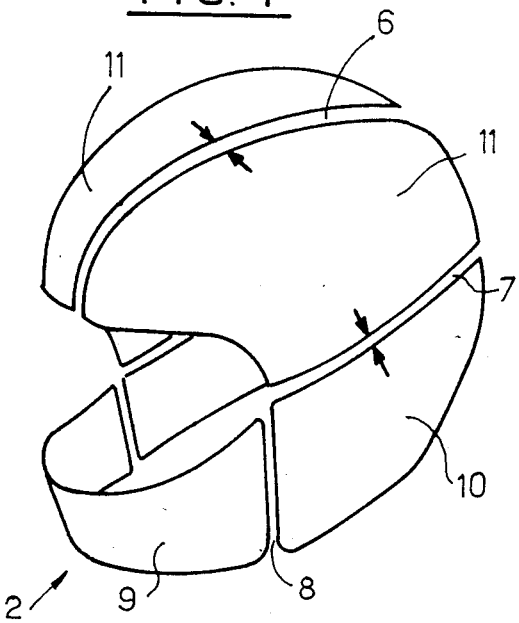
FIG. 4 is a perspective view of a first form of embodiment of the helmet.

According to FIG. 4, the sutures 6, 7, 8 essentially represent sutures equivalent to the sutures which join the bones of the skull. These sutures define a plurality of different and separate pieces intended to be assembled in order to form the helmet 2.

In this particular form of embodiment, the sutures 6, 7 and 8 define a chin guard 9, a base part 10 and two top parts 11. The parts 9, 10, 11 are asssembled inter se by an interlocking type of fitment. Such assembly is performed in flexible fashion. A clearance is left between the parts 9, 10, 11 forming the parts of the helmet. The clearance existing between the parts 9, 10, 11 allows limited relative displacement of the parts inter se following an impact.

According to this particular embodiment, the sutures are of general rectilinear form.

Without departing from the framework of the invention, it is possible to imagine providing a protective helmet of which the sutures are constituted only by lines of weakness defining various parts similar to the parts 9, 10, 11 described in FIG. 4. These lines of weakness can be obtained, for example, by a succession of perforations which form strips. These strips of perforations naturally extend in the form of a sagittal strip, a horizontal strip and a vertical strip similar to the helmet 2 shown in FIG. 4.

According to FIG. 5*a*, the helmet 2 is provided with a chin guard 9 connected to the base part 10 by a hinge which permits pivoting of the chin guard in accordance with the arrow G. According to this drawing, the chin guard is shown in the open position. The possibility of opening and closing the chin guard 9 in order to put on the helmet obviates the need to provide an additional jaw fastening system such as is provided in conventional integral helmets.

According to FIG. 5*b*, the helmet 12 is provided with a chin guard 9 connected to the base part 10 by two fastening devices 13 which permit of forwards displacement of the chin guard 9 according to the arrow G' so that it moves into the opening position.

According to FIG. 6, the helmet 14 is provided with a sagittal suture 15 and horizontal suture 16 having the general form of a sinusoidal line. This particular form defines parts 17 and 18 of what is referred to as a "postage stamp" shape. This particular form of the sutures makes it possible to dampen the translatory movements of the parts 17, 18 in the different directions.

According to FIG. 7*a*, the suture 19 permits of assembly of a part 20 and a part 21, the suture 19 corresponding, for example, to a sagittal or horizontal suture. In the case of a sagittal suture, this is for assembling the two top parts of the helmet while in the case of a horizontal suture, this is provided for assembling a top part to a base part.

The parts 20 and 21 comprise sinusoidal cut-outs in the vicinity of their junction line. The junction lines 22 of two adjacent parts 20, 21 exhibit a corresponding profile defining an interlocking fitment means in the form of an inverted tooth. A flexible acoustic seal 23 is clamped between the top faces of the parts 20, 21 along the suture 19.

According to FIG. 7*b*, the underside 24 of the part 21 is provided with a locking stud 25 which engages in a hollow part 26 provided in the upper face 27 of the part 20.

According to FIG. 8*a*, the suture 28 corresponds to a somewhat more improved method of assembly of the parts 29, 30 compared with the assembly of the parts 20, 21 described with reference to the preceding FIG. 7*a*.

In this particular form of embodiment, the part 29 is provided with an intermediate plate 31 which, in the engaged position, is extended in a recessed housing 32 in the part 30. An acoustic seal 33 is clamped in the bottom of the housing 32 by the intermediate plate 31. This assembly has the advantage of making it possible to clamp the seal 33 in a rectilinear fashion, whereas in the embodiment shown in FIG. 7*a* prior thereto, the seal 23 followed a sinusoidal line.

According to FIG. 8*b*, the underside 34 of the part 30 is provided with a locking stud 35 engaging in a recessed part 36 disposed in the upper face of the intermediate plate 31 of the part 29.

According to FIG. 9, the suture 38 has the general form of a crenellated line.

According to FIG. 10, the suture 39 has the general form of a broken line. Obviously, other forms of suture may be used without departing from the framework of the invention.

I claim:

1. A protective helmet for sport or work or the like, said helmet comprising: a plurality of parts including a base (10), a chin guard (9), and two top parts (11) and suture means (6, 7, 8) so connecting the foregoing plurality of parts into an assembled relationship as to permit a limited displacement of said parts relative to each other as the result of a shock, said suture means (6, 7, 8) comprising sutures which essentially duplicate the sutures of the human skull and include at least one saggital suture (6) connecting the two top parts (11) of said helmet together, two vertical sutures (8) connecting the chin guard (9) of said helmet to the base (10) thereof, and at least one horizontal suture (7) connecting each of said top parts (11) to the base (10) of the helmet, thereby permitting said limited displacement of said helmet parts (9, 10, 11) to occur along lines essentially duplicating the sutures of the human skull.

2. A protective helmet according to claim 1, characterized in that the sutures (6, 7, 8) are constituted by perforations providing lines of weakness between the parts of said helmet.

3. A protective helmet according to claim 1, characterized in that said suture means connects the aforesaid helmet parts together in flexible fashion and in that there is a clearance between the parts (9, 10, 11) which are assembled to form the helmet which permits the aforesaid limited displacement of those parts (9, 10, 11) relative to each other as the result of an impact.

4. A protective helmet according to claim 1, characterized in that the suture between the two top parts (11) of the helmet and the sutures between those two parts (11) of the helmet and the base (10) thereof have sinusoidal configurations and in that said sutures (15, 16) follow said sinusoidal lines.

5. A protective helmet according to claim 3, characterized in that the suture between two of said plural parts is defined by interlocking teeth on said two parts, there being upper and lower rows of teeth on each of said parts and the teeth in each of said rows on each of said parts alternating with the teeth in the other of the rows, said helmet further being characterized by an acoustical seal clamped between said parts at a level corresponding to said upper row of teeth.

6. A protective helmet s defined in claim 3, characterized in that one of two mating parts thereof includes an intermediate plate and the other of said parts has a matching recess into which said plate can be fitted to lock said mating parts together, said helmet further comprising an acoustical seal disposed between said mating parts and clamped into said recess by said intermediate plate.

7. A protective helmet according to claim 6, characterized in that said other of said mating parts includes a depending locking stud and said one of said parts has a recess in the upper surface of said intermediate plate in which said stud can be engaged to lock said mating parts together.

8. A protective helmet according to claim 3, characterized in that one of two mating parts thereof includes a depending locking stud and the other of said parts has a recess opening onto the upper surface thereof in which said locking stud can be engaged to lock said mating parts together.

9. A protective helmet as defined in claim 1, further comprising means for pivotally connecting said chin guard to the base part of the helmet.

10. A protective helmet as defined in claim 1, further comprising means for so connecting said chin guard to the base part of said helmet as to provide for translatory movement therebetween.

* * * * *

UNITED STATES PATENT AND TRADEMARK OFFICE

CERTIFICATE OF CORRECTION

PATENT NO. : 4,665,569

DATED : 19 May 1987

INVENTOR(S) : Jean-Jacques G.R. Santini

It is certified that error appears in the above—identified patent and that said Letters Patent is hereby corrected as shown below:

IN THE SPECIFICATION:

Column 1, line 62, "characteritic" should read --characteristic--.

Column 2, line 52, "on" should read --of--.

Column 3, line 38, "the", second occurrence, should read --The--.

Signed and Sealed this

Fifteenth Day of October, 1991

*Attest:*

*Attesting Officer*

HARRY F. MANBECK, JR.

*Commissioner of Patents and Trademarks*